US007906205B2

(12) United States Patent
Meres

(10) Patent No.: US 7,906,205 B2
(45) Date of Patent: Mar. 15, 2011

(54) SOUND ABSORBING STRUCTURES

(75) Inventor: Oskar Meres, Vallensbaek Strand (DK)

(73) Assignee: Rockwool International A/S, Hedehusene (DK)

( * ) Notice: Subject to any disclaimer, the term of this patent is extended or adjusted under 35 U.S.C. 154(b) by 911 days.

(21) Appl. No.: 10/592,465

(22) PCT Filed: Feb. 11, 2005

(86) PCT No.: PCT/EP2005/001372

§ 371 (c)(1),
(2), (4) Date: Sep. 11, 2006

(87) PCT Pub. No.: WO2005/078206

PCT Pub. Date: Aug. 25, 2005

(65) Prior Publication Data

US 2007/0059482 A1 Mar. 15, 2007

(30) Foreign Application Priority Data

Feb. 11, 2004 (GB) ..... 0403035.9

(51) Int. Cl.
*B32B 27/08* (2006.01)
*B05D 3/00* (2006.01)

(52) U.S. Cl. ..... 428/316.6; 428/317.1; 428/317.9; 52/144; 52/145; 427/407.1

(58) Field of Classification Search ..... 428/316.6, 428/319.3, 319.7, 317.1; 52/144, 145
See application file for complete search history.

(56) References Cited

U.S. PATENT DOCUMENTS

| | | | | |
|---|---|---|---|---|
| 4,010,134 | A * | 3/1977 | Braunisch et al. | 252/62 |
| 4,916,167 | A * | 4/1990 | Chen et al. | 521/159 |
| 5,732,520 | A * | 3/1998 | Maietta | 52/483.1 |
| 6,443,258 | B1 * | 9/2002 | Putt et al. | 181/294 |
| 6,998,430 | B2 * | 2/2006 | Tanasi | 523/220 |
| 7,021,018 | B2 * | 4/2006 | Peng | 52/549 |

FOREIGN PATENT DOCUMENTS

| | | | |
|---|---|---|---|
| CA | 1190376 | A * | 7/1985 |
| DE | 40 32 769 | A1 | 5/1991 |
| EP | 0 086 681 | A | 8/1983 |
| FR | 2 442 808 | A | 6/1980 |

* cited by examiner

*Primary Examiner* — Hai Vo
(74) *Attorney, Agent, or Firm* — Dickstein Shapiro LLP

(57) ABSTRACT

A sound-absorbing structure is provided which comprises a plurality of sound-absorbing tiles or other elements fitted in position, filler cast between the elements so as to provide a substantially flat surface with the elements, and a monolithic rendering which is porous but extends over the substantially flat surface and provides a very smooth surface without significantly reducing the sound-absorbing properties of the elements.

19 Claims, No Drawings

SOUND ABSORBING STRUCTURES

This invention relates to sound absorbing structures such as sound absorbing walls or ceilings.

There are two general methods for providing such structures. The method which gives the best sound absorbing properties generally consists of making preformed sound absorbing panels, tiles or other elements and fitting these preformed elements to the ceiling or wall in such a manner that the elements substantially abut one another. This method has the advantage that the manufacture of the elements can be conducted in such a way that they have very good sound absorbing properties, but it has the disadvantage that the joins between adjacent edges are visible, even when a filler is cast between the joins in an attempt to minimise the appearance of the joins.

The second method involves applying a rendering on to an appropriate substrate, such as a brick or concrete wall or plaster board ceiling, whereby the rendering is formulated so as to provide sound absorbing properties. However these sound absorbing properties are usually significantly inferior compared to those easily achievable using preformed sound absorbing elements. Examples of disclosures of sound absorbing renderings are in U.S. Pat. No. 2,921,862 and DE-A-3,607,438.

Various techniques are known for making preformed sound absorbing elements, and these include constructing the basic element in such a way (for instance by orientation of fibres or apertures) to maximise sound absorption properties. Some of the techniques involve applying a sound absorbing coating over a mineral wool substrate. Examples are in DE-A-3,932,472 and EP-A-1,088,800.

The present situation therefore is that the best sound absorbing properties are achieved using preformed elements but these necessarily have joins between the edges of adjacent elements, whereas less satisfactory sound absorbing properties can be obtained with a monolithic surface (i.e., an apparently continuous and uninterrupted surface).

The problem is to be solved in the provision of sound absorbing structures having a monolithic, smooth, surface similar to conventional plaster or plasterboard but which has sound absorbing properties as high as, or almost as high as, are obtainable using sound absorbing elements such as panels or tiles.

If a monolithic surface is provided by applying a conventional plaster rendering over the sound absorbing elements, with or without filler cast between the elements, the sound-absorption properties are seriously reduced and this is unsatisfactory.

WO00/47836 is concerned with the problem of constructing walls from preformed elements, and in particular elements of corrugated sheet material. It proposes that the elements should be rendered with a rendering and that this rendering not only covers the elements but will also seal gaps around the elements. It mentions that the rendering can have sound absorption properties. The system therefore gives a monolithic surface starting from individual elements, but the sound absorption properties will be dictated solely by the sound absorption properties of the rendering. Accordingly, although this is concerned with sound absorption properties starting from preformed elements, and it does give a monolithic surface, the sound absorption properties are not significantly better than those obtained by rendering a conventional concrete or other surface with a sound absorbing rendering.

Sound absorbing renderings usually contain coarse fibrous or other particulate material in order to provide them with the physical structure that results in sound absorption. For instance the rendering may contain mineral fibres, such as the asbestos mentioned in U.S. Pat. No. 2,921,862 or, mineral wool fibres instead of the asbestos fibres in that. The application of such a rendering over elements can be capable of giving a monolithic surface which is reasonably flat if a filler has been cast in the joints but it will still not be smooth relative to the conventional smoothness of a plaster or plaster board surface. Accordingly, applying an acoustic, mineral; fibre, rendering would provide a surface which is rough on a microscale and would not satisfy the requirement for a smooth monolithic appearance resembling conventional plaster.

A sound-absorbing structure selected from ceilings and walls is now provided and comprises a plurality of substantially abutted, sound-absorbing, elements having an acoustic absorption coefficient $\alpha_w$ of at least 0.7, filler which is cast and cured between the elements whereby the filler and the elements provide the structure with a substantially flat surface and a physically or chemically cured, porous, monolithic rendering bonded to and extending substantially entirely over the substantially flat surface and which is smooth, and the structure has an acoustic absorption coefficient of at least 0.6.

Preferably the smooth rendering has a surface roughness such that Sa is below 140 μm preferably 40 to 140 (e.g., 60-140) μm. Preferably the rendering has a roughness such that Sq is below 170 μm preferably 50 to 170 (e.g, 90 to 170) μm. Preferably the rendering has a roughness such that Sz is below 900 μm preferably 300 to 900 (e.g., 700 to 900) μm and The surface roughness values Sa (amplitude parameter), Sq (root mean square deviation) and Sz (extreme amplitude parameter) are determined in conventional manner, for instance as described in Surface Topography, second edition, by Stout and Blunt, published by Pentan Press pages 156 and 166 and in Precision—Handbook of Surface Metrology by Whitehouse published by Rank Taylor Hobson, pages 12 to 14.

A surface having some or all of these values will appear to be truly smooth and will be aesthetically comparable to a conventional plaster or plaster board surface, which is the appearance which is desired in the invention. However these values allow for some microscale roughness in the surface which is grater than in conventional plaster and plasterboard surfaces and this helps to improve the aesthetic appearance of the surface if the filler has not provided a perfectly flat surface.

Preferably the surface complies with at least two of the defined values (Sa, Sq and Sz) and preferably it complies with all three.

The acoustic absorption coefficient $\alpha_w$ is determined in accordance with I.S.O.354:2003 and is measured 200 mm from the surface. $\alpha_w$ of the initial elements is preferably at least 0.8 or 0.85 and often at least 0.9 or 0.95. The sound absorbing elements in the invention are elements which have $\alpha_w$ as high as is reasonably possible, and it is important in the invention that the rendering does not reduce the absorption coefficient too seriously. Generally therefore the absorption coefficient of the substantially flat and smooth monolithic rendering is not more than 0.05, 0.1, or at the most 0.2 units less than the coefficient for the elements. Accordingly $\alpha_w$ of the final structure, carrying the monolithic rendering, is preferably at least 0.7 or 0.8, most preferably at least 0.85 and often at least 0.9 or even 0.95 when the element has a very high $\alpha_w$.

The structure is conveniently made by a process comprising assembling on the surface of a wall or ceiling the plurality of substantially abutted sound-absorbing elements, casting filler between the substantially abutting elements and physically or chemically curing the cast filler and, if necessary, smoothing the cured cast filler and thereby providing the substantially flat surface, if necessary applying a primer coat over the cured cast filler to reduce its water absorption, applying over substantially the entire substantially flat surface an uncured rendering which is a viscous fluid composition containing an aqueous fluid phase in which is suspended insoluble particulate material which consists of particulate material having a maximum dimension below 2 mm and wherein the aqueous phase comprises an uncured binder and entrained gas microbubbles, and physically or chemically curing the binder and thereby forming the smooth, cured, porous monolithic rendering.

In order that the monolithic coating provides the defined smooth monolithic surface it is necessary that the substrate (i.e., the assembly of sound-absorbing elements with filler cast between them) should be as level and as smooth as possible and that the rendering should dry reasonably uniformly after application. It is therefore often desirable to treat parts of the assembly of elements and filler so as to achieve an adequately uniform rate of drying of the fluid rendering. This allows the attainment of substantially uniform bonding of the rendering over the entire surface. However primer is preferably not applied where it is not required for improving drying and bonding, since it can reduce the acoustic properties of the underlying surface.

In particular it can be desirable to apply a primer over the cast filler, but generally not over the sound absorbing elements. This is because cast filler should generally be smoothed by sanding or other conventional method before applying the rendering. Fillers which are capable of being smoothed adequately relatively quickly after initial casting tend to be porous. In particular, optimum fillers, from the point of view of curing and smoothing, are often based on gypsum and such fillers tend to be porous. Accordingly, it is sometimes desirable to apply primer over filler which has been cast, cured and smoothed if the porosity of the filler is then significantly different from the porosity of the remainder of the surface, i.e., the elements.

The primer can be any suitable water-based or other primer paint that will result in the surface having a satisfactorily controlled degree of absorbency.

Preferably the filler which is used is a filler which sets to give a porosity sufficiently similar to the porosity of the panels, tiles or other elements such that the rendering will coat and dry substantially uniformly over the filler and the surfaces of the other elements without the need to apply primer over the filler. The filler may be fillers based on a hydraulic binder, for instance fillers based on gypsum or cement. Such fillers are generally provided by mixing with water a gypsum powder or other suitable powder containing hydraulic binder, applying the resultant paste, and leaving it to set and dry. However, it is often preferred to use a filler containing an organic binder instead of a hydraulic binder, for instance a filler which is supplied as a paste including a latex or other organic binder. The presence of the organic binder can promote adhesion of the filler to its underlying surface, and can also improve the texture of the surface of the set filler, relative to hydraulic fillers.

It is important in the invention that the rendering must be porous in order that it does not reduce the absorption coefficient too seriously. If the rendering does reduce the absorption coefficient too seriously (relative to the absorption coefficient of the elements underneath the rendering) then the advantages of using these elements is reduced or lost.

Accordingly, in the invention the rendering is preferably not a rendering which would normally be considered as an acoustic rendering. Instead, the rendering is sufficiently porous that the sound reaching the surface of the rendering travels through the pores and is absorbed predominantly by the sound absorbing elements. The pores should therefore be open pores which interconnect between the front surface of the rendering and the surface of the elements on which the rendering is applied. Accordingly the porosity is preferably of the type which is due predominantly to pores created by microbubbles escaping from the rendering after application to the surface but before and during curing of the rendering. Accordingly a foaming agent is preferably included.

The microbubbles can be created by the presence of surfactant (preferably a soap) as foaming agent, combined with vigorous agitation in air. Instead of or in addition to this the rendering is provided by mixing particulate material, binder and water and creating the microbubbles, and optionally larger bubbles, by chemical decomposition within the fluid phase and stirring the resultant fluid composition to distribute the microbubbles uniformly through the composition and to disperse and/or break any larger bubbles into microbubbles.

The microbubbles may be formed by chemical decomposition of a carbonate or bicarbonate in the composition with acid dissolved in the aqueous phase.

However it is not essential to use chemical decomposition in order to generate the microbubbles and the desired open pore structure. For instance the rendering may include delayed release microcapsules which will release, during curing of the rendering, material which either is gaseous or which will react with other components in the rendering to form gas, in order to provide pores extending through the rendering.

In order that the final rendered surface is smooth, the particle size distribution of the particulate material in the rendering should be selected appropriately. The particles in the rendering are usually bonded by physically or chemically cured bonding agent wherein the particulate material consists of particulate material having a maximum dimension below 1 mm and a particle size distribution which allows for the achievement of the defined smoothness.

Pigment such as titanium dioxide is normally included as part of the particulate material, for instance in amounts of from 0.3 to 10% of the dry render. Fine extender or filler such as talc can be included as part of the particulate material, for instance in amounts of from 1 to 20% of the dry render. Hollow fillers such as glass spheres may be used.

The major components (for instance at least 60 or 70% and preferably at least 80, 90 or 95% by weight of the dry render) are usually conventional, fine, particulate materials having a maximum size which is below 2 mm and is usually below 1 mm and having an average size which is usually below 1 mm, preferably below 0.5 mm and most preferably below 0.1 or 0.2 mm, and preferably includes very fine material, so as to promote the formation of a smooth surface. Examples are quartz sand and lime (calcium carbonate) and dolomite (magnesium, or calcium magnesium, carbonate).

Preferably the render is substantially free of rock fibres since the acoustic benefits they provide to acoustic renderings are not needed in the invention, and such fibres usually prevent adequate smoothness being obtained. However small amounts (e.g., below 5% and preferably below 1%) may be included provided they do not prevent the achievement of the required smoothness. Similarly, appropriately low amounts of other fibres may be included provided they do not prevent achievement of the desired smoothness. Examples are synthetic polymeric fibres for instance acrylic fibres or polyester fibres, typically having a fibre length less than 500 μm and preferably less than 200 μm and often less than 100 μm. The fibre diameter may be less than 50 μm and preferably less than 20 μm and is often around 1 to 10% of the length. The amount is usually from 1 to 5% based on the dry render. Often the render is free of fibrous material or contains, at most, not more than 5% and often not more than 2%, based on weight of dry render.

The overall combination of particulate material, fibre if present, and other components must be such that the dried and cured rendering has the required surface smoothness, and this necessitates that the rendering does not contain significant amounts of conventional mineral wool fibres.

Typically, the dry content of the rendering comprises 1 to 20% physically or chemically cured binder, 70 to 99% water insoluble particulate material wherein the particulate material has a maximum dimension of 1 mm and 0 to 20% water soluble or dispersible additives, such as surfactants.

The viscous fluid composition which is used to form the cured render is usually formed by mixing water insoluble particulate materials as powder or as a preformed aqueous paste with foaming agent and sufficient water to provide the required rheology. The total amount of water is generally about 15 to 55%, often 25 to 45%, by weight of the fluid render. All the necessary ingredients other than water may be in a single powdered mix or paste or the majority may be provided in a powdered mix or paste and a minor amount may be provided either in a separate powdered mix or in a liquid form.

The total ingredients must include binder and viscosifier which is selected to optimise the rheology of the composition during and after application. The same material may serve both purposes but often it is preferred to use different materials, one contributing predominantly to the binder properties and another contributing predominantly to the rheology properties.

The binder cures physically or chemically. Physical curing occurs when, for instance, a film-forming binder dries to form a film. Chemical curing occurs when, for instance, a hydraulic material such as cement or gypsum cures to a solid cured form or when a organic polymer cross links or otherwise cures to form a dried, generally insoluble polymer. It is preferred that the binder and/or the rheology adjusting material (if different) should be film-forming so as to promote the formation of a smooth film surface as the fluid render dries after application.

The binder may be an inorganic hydraulic binder such as cement or gypsum or lime or a mixture thereof but often it comprises an organic polymer. The rheology adjusting material generally comprises organic polymer. Organic polymers which may be used as binder or rheology adjusting materials (e.g., thickeners) can be selected from any of the polymers which are conventional for such purposes, including natural polymers such as cellulosic or modified cellulosic polymers (such as methyl cellulose or carboxymethyl cellulose), or starches, or synthetic polymeric thickeners or binders such as homopolymers of acrylamide and/or acrylic acid.

Organic polymer included in the composition may be acidic in order to provide the acidic conditions which can be utilised to cause the liberation of carbon dioxide. Instead of, or in addition to this, other acid can be included either in powder form or as a liquid.

It is generally preferred that the binder is predominantly or wholly organic (for instance a styrene acrylic or other acrylic emulsion, the thickener is primarily organic (for instance a cellulosic ether or acrylic thickener) and that any fibres are predominantly organic, for instance acrylic fibres. Suitable fillers for the composition are usually inorganic and of very fine particle size, for instance calcium magnesium carbonate (dolomite), calcium carbonate, quartz or other silica compounds.

It is particularly preferred for the non-aqueous components of the render to comprise 1 to 20%, preferably 2 to 10% by weight organic water soluble dispersible materials and 70 to 99% by weight inorganic particulate material provided by, for instance, 10 to 50% calcium carbonate and a generally larger amount, 30 to 70%, by weight quartz sand or other sand, with the balance being other inorganic particulate materials having the desired size distribution.

The rendering may be applied in one or more coats, but generally it is not necessary to apply more than two coats. The surface of the rendering may have the required smoothness as a result of merely applying the rendering and allowing it to cure and set. It is often desirable to smooth the final surface (or an intermediate surface if more than one coat is applied) by sanding or grinding in order to remove major blemishes in the surface and to improve its overall smoothness.

In order to construct the sound-absorbing structure comprising the sound-absorbing elements, the filler and the rendering, it is necessary to provide not only the elements but also the filler in a form capable of being cast and cured and a powdered rendering composition for mixing with water, and optionally with other fluid ingredients, to form a viscous fluid rendering composition.

Several types of sound-absorbing elements having the required high values of $\alpha_w$ (above 0.7 and preferably at least 0.9 or 0.95) and which are in panel or tile form are well known and can be used in the invention. Suitable elements based on mineral fibres are available under the trade name Rockfon. Other examples are shown in EP-A-0652331 and EP-A-1154087. Elements formed mainly of rock fibres are preferred.

The elements often have a painted fleece covering. They are fitted to the ceiling or wall in conventional manner, either by direct application and adhesion to a solid surface or, more usually, by fitting on to a grid of support elements (such as the Rock Link 24 system supplied by Rockfon Limited of Bridgend, Glamorgan) in which event the sound-absorbent elements are preferably Rockfon Mono Acoustic tiles.

Filler, for instance a gypsum based filler, is then applied into and over the joins between the elements and is cast into and over these joins in conventional manner and allowed to cure. The filler is then sanded, and usually the elements are also lightly sanded to ensure that there are no unwanted particles or other deformations on their surface, to provide an overall surface which is as flat as possible. Nevertheless it is never, in practice, as flat and as smooth as is aesthetically required for a monolithic surface.

The filler not only serves to fill between the elements so as to provide a substantially flat surface but it also serves to promote the security of the fastening of the elements in position and so may eliminate the need for adhesive or other fastening system.

The filler is usually a material optimised for these purposes, such as a cement based filler or, preferably, a gypsum based filler. However with some formulations of the powdered rendering, it is possible to use the same material as filler as is used for the rendering.

The panels, tiles or boards which have been fitted to the wall or ceiling usually already have an external surface which is painted, usually a painted fleece, but if necessary a primer may be applied over the filler only so as to provide substantially uniform absorbency properties throughout, especially when the filler is based on gypsum. The primer can be a conventional primer paint, for instance a water based paint.

The dry composition for forming the viscous fluid rendering composition is then mixed with water, and any other fluid ingredients that are required. This composition comprises physically or chemically curable binder and water insoluble particulate material having the desired particle size range and usually includes materials which will form an acidic solution which will react with carbonate to form carbon dioxide or will contain some other foaming system.

A suitable composition comprises 1 to 5%, preferably 3 to 4% acrylic or other organic fibres, 1 to 5%, often 1 or 2% up to 3%, of a viscosifier such as a cellulose ether or acrylic thickener, 0.3% to 5% and preferably 2 to 4% (dry weight) organic binder, generally a styrene acrylic or other acrylic emulsion, optionally 0.1 to 0.3% antibacterial and fungal agent, 40 to 70%, often 50 to 70%, fine filler such as calcium magnesium carbonate, calcium carbonate, quartz or other silicon compound, and foaming agent soap (typically 0.05 to 1%, preferably 0.1 to 0.3 or 0.5%), and/or an acid which will react with the filler optionally in larger amounts, and water in an amount of 20 or 25% to 40%.

It is usually convenient to initiate the foaming by mixing some or all of the ingredients which will cause foaming thoroughly before mixing them fully with all the particulate material. Once foaming is well established, the aqueous foaming liquid is then mixed thoroughly with the remainder of the particulate material. Initially it may be seen that there is a non-uniform distribution of gas within the composition but mixing is continued until a uniform texture, similar to stiff whipped cream, exists.

This composition is then sprayed on to the substantially flat surface of filler and sound-absorbing element. The distance between the spray nozzle and the substantially flat surface is often in the range 200 to 1400 mm, often 300 to 1000 mm, most preferably 400 to 700 mm. The amount of render is usually in the range 0.4 to 1.8, preferably 0.6 to 1.6 and most preferably 0.8 to 1.4, liters per minute. The diameter of the spray nozzle is generally 2 to 8 mm, preferably 3 to 6 mm and most preferably around 4.5 to 7 mm, e.g., 6 mm.

Preferably around 0.3 to 0.5 kg/m$^2$ (dry weight) of render is applied in a single application. The surface is then allowed to dry, for instance for at least 8 hours at ambient temperature. A second coat of render is then usually applied and allowed to dry. Sometimes it is desirable to apply a third coat. The rendering may be smoothed by sanding or grinding, as explained above.

The overall amount of render is generally from 0.5 or 1 kg to 3 kg/m$^2$. The total amount of render is usually at least 0.5 kg/m$^2$ (for instance achieved by application of a single coating of 0.5 kg/m$^2$) and it usually extends up to 0.8 or 1 kg/m$^2$ (for instance 2 layers of 0.5 kg/m$^2$). Although it is not usually necessary, it can extend up to 2 or 2.5 kg/m$^2$ of significant amounts of the render are to be removed by sanding or grinding, the rate of application may be increased in order to give these quantities in the final structure after smoothing.

The average thickness of the coating can be as low as 0.3 mm but is often at least 0.5 mm. It can be as much as 2 mm, but it is preferably not more than 1.5 mm. Accordingly it will be seen that the rendering which is applied in the invention is so thin, relative to normal acoustic renderings, that it cannot contribute to the sound absorbing properties. However, as a result of its porosity, it does not reduce significantly the sound-absorbing properties of the underlying elements.

The invention claimed is:

1. A sound-absorbing structure selected from ceilings and wails and comprising a plurality of substantially abutted, sound-absorbing, elements in the form of tiles or panels having, an acoustic absorption coefficient aw of at least 0.7, filler which is cast and cured between the elements whereby the filler and the elements provide the structure with a substantially flat surface and a physically or chemically cured, porous, monolithic rendering bonded to and extending substantially entirely over the substantially flat surface and which is smooth and the structure has an acoustic absorption coefficient aw of at least 0.6, wherein the cured monolithic rendering comprises particulate material bonded by physically or chemically cured bonding agent wherein the particulate material consists of particulate material having a maximum dimension below 2 mm and a particle size distribution which allows for the achievement of the defined smoothness, and wherein the porous, monolithic rendering has open pores which interconnect the substantially flat surface on which the rendering is disposed with an opposing front surface of the rendering.

2. A structure according to claim 1 in which the elements have an acoustic absorption coefficient aw of at least 0.85 and the structure has a tower acoustic absorption coefficient of at least 0.8.

3. A structure according to claim 2 in which the monolithic rendering has a thickness of not more than 2 mm.

4. A structure according to claim 1 in which the monolithic rendering has a dry weight of up to 2 kg/m$^2$.

5. A structure according to claim 1 in which the monolithic rendering has a surface roughness such that Sa is below 140 μm, Sq is below 170 μm and Sz is below 900 μm.

6. A structure according to claim 1 in which the smooth rendering has a surface roughness such that Sa is 40 to 140 μm.

7. A structure according to claim 1 in which Sq is 50 to 170 μm.

8. A structure according to claim 1 in which Sz is 300 to 900 μm.

9. A structure according to claim 1 in which the cast filler is water absorbent and there is a water absorbency-reducing priming coat between the filler and the rendering to promote bonding of the rendering to the filler.

10. A structure according to claim 1 in which the porosity of the cured monolithic rendering is due predominantly to pores created by microbubbles escaping from the rendering before and during curing of the rendering.

11. A structure according to claim 1 in which the bonding agent is a film-forming water soluble or dispersible organic polymeric material cured chemically and/or cured physically by drying the bonding agent while in liquid form.

12. A structure according to claim 1 in which the cured monolithic rendering is free of inorganic fibres but optionally comprises synthetic polymeric fibres.

13. A structure according to claim 1 in which the monolithic rendering comprises 1 to 20 wt % physically or chemically cured bonding agent, 70 to 99 wt % water insoluble particulate material 0 to 20 wt % water soluble or dispersible additives, and 0-5 wt % organic fibers.

14. A structure according to claim 1 in which the monolithic rendering has a thickness of not more than 2 mm.

15. A structure according to claim 14 in which the monolithic rendering has a dry weight of up to 2 kg/m$^2$, a surface roughness such that Sa is below 140 μm, Sq is below 170 μm and Sz is below 900 μm.

16. A structure according to claim 15 in which the smooth rendering has a surface roughness such that Sa is 40 to 140 μm.

17. A structure according to claim 16 in which the bonding agent is a film-forming water soluble or dispersible organic polymeric material cured chemically and/or physically by drying the bonding agent while in liquid form.

18. A process for forming a structure according to claim 1 comprising assembling on the surface of a wall or ceiling the plurality of substantially abutted sound-absorbing elements in the form of tiles or panels, having an acoustic absorption coefficient aw of at least 0.7, casting filler between the substantially abutting elements and physically or chemically curing the cast filler and, if necessary, smoothing the cured cast filler and thereby providing the substantially flat surface, if necessary, applying a primer coat over the cured cast filler to reduce its water absorption, applying over substantially the entire substantially flat surface an uncured rendering which is a viscous fluid composition containing an aqueous fluid phase in which is suspended insoluble particulate material which consists of particulate material having a maximum dimension below 2 mm and a particle size distribution which allows for a smooth rendering, and wherein the aqueous phase comprises an uncured bonding agent and entrained gas microbubbles, and physically or chemically curing the bonding agent and thereby forming the smooth, cured, porous monolithic rendering having open pores which interconnect the substantially flat surface on which the rendering is disposed with an opposing front surface of the rendering and the structure having an acoustic absorption coefficient aw of at least 0.6.

19. A process according to claim 18 in which the fluid phase is form by mixing the particulate material, bonding agent and water and creating the microbubbles, and optionally larger bubbles, by chemical decomposition of a carbonate within the fluid phase and stirring the resultant fluid composition to distribute the microbubbles uniformly through the composition and to disperse and/or break into microbubbles and larger bubbles.

* * * * *